US007971935B2

(12) United States Patent
Saez et al.

(10) Patent No.: US 7,971,935 B2
(45) Date of Patent: Jul. 5, 2011

(54) ERGONOMIC SIDE CHAIR

(75) Inventors: Manuel Saez, Brooklyn, NY (US); Lachezar Tsvetanov, Bridgeport, CT (US)

(73) Assignee: Humanscale Corporation, New York, NY (US)

( * ) Notice: Subject to any disclaimer, the term of this patent is extended or adjusted under 35 U.S.C. 154(b) by 366 days.

(21) Appl. No.: 11/277,450

(22) Filed: Mar. 24, 2006

(65) Prior Publication Data

US 2007/0222268 A1 Sep. 27, 2007

(51) Int. Cl.
*A47C 7/40* (2006.01)

(52) U.S. Cl. ..... 297/285; 297/301.1; 297/354.11; 297/446.1; 297/452.15

(58) Field of Classification Search ..... 297/195.1, 297/215.16, 284.4, 440.21, 446.1, 448.1, 297/452.15, 452.31, 285, 291, 301.1, 354.11
See application file for complete search history.

(56) References Cited

U.S. PATENT DOCUMENTS

| | | | | |
|---|---|---|---|---|
| 1,022,858 | A | 4/1912 | Markus | |
| 1,490,132 | A * | 4/1924 | Sheehy | 248/188.9 |
| 1,526,920 | A * | 2/1925 | Liptak | 248/624 |
| 2,725,096 | A * | 11/1955 | Granby | 297/452.13 |
| 2,967,565 | A | 1/1961 | Schultz | |
| 3,774,960 | A | 11/1973 | Blodee | |
| 4,047,757 | A | 9/1977 | Eames et al. | |
| 4,390,204 | A | 6/1983 | Fleishman | |
| 4,418,958 | A * | 12/1983 | Watkin | 297/452.15 |
| 4,500,137 | A * | 2/1985 | Morehouse | 297/452.21 |
| 4,533,174 | A | 8/1985 | Fleishman | |
| 4,660,887 | A * | 4/1987 | Fleming et al. | 297/448.2 |
| 5,112,108 | A * | 5/1992 | Zapf | 297/291 |
| 5,123,702 | A | 6/1992 | Caruso | |
| 5,129,707 | A * | 7/1992 | Yamauchi | 297/216.14 |
| 5,154,485 | A * | 10/1992 | Fleishman | 297/446.1 |
| 5,338,094 | A * | 8/1994 | Perry | 297/411.4 |
| 5,403,067 | A | 4/1995 | Rajaratnam | |
| 5,490,715 | A | 2/1996 | Opsvik | |
| 5,577,811 | A | 11/1996 | Ogg | |
| 5,626,394 | A | 5/1997 | Perry | |
| 5,697,673 | A | 12/1997 | Favaretto | |
| 5,806,931 | A * | 9/1998 | Kogai | 297/301.3 |
| 5,868,468 | A | 2/1999 | Wang | |
| 5,887,946 | A | 3/1999 | Raftery | |
| 5,997,094 | A | 12/1999 | Cvek | |

(Continued)

FOREIGN PATENT DOCUMENTS

EP 0216578 A 4/1987

(Continued)

OTHER PUBLICATIONS

International Preliminary Report on Patentability by the International Preliminary Examining Authority—US for PCT Application No. PCT/US2007/64517 issued on May 1, 2009.

*Primary Examiner* — Peter R. Brown
(74) *Attorney, Agent, or Firm* — Jones, Walker, Waechter, Poitevent, Carrere & Denegre, L.L.P.

(57) ABSTRACT

An ergonomic chair having a seat with selectively located slot patterns or spring mechanisms to reduce pressure on the occupant of the seat and a flexible back that allows the occupant to recline while at the same time providing lumbar support. An embodiment of the chair may be telescopically stacked in a space-saving configuration of a plurality of identical chairs.

38 Claims, 8 Drawing Sheets

U.S. PATENT DOCUMENTS 6,056,361 A * 5/2000 Cvek ..... 297/300.2
6,129,415 A 10/2000 Galloway
D456,164 S * 4/2002 Vanderiet et al. ..... D6/374
6,409,268 B1 6/2002 Cvek
6,722,735 B2 4/2004 Lucci
6,817,667 B2 11/2004 Pennington
6,843,529 B2 1/2005 Ballendat
6,957,860 B1 10/2005 Leist et al.
7,032,971 B2 * 4/2006 Williams ..... 297/284.4
7,128,372 B2 * 10/2006 Farquhar et al. ..... 297/284.4
7,396,078 B2 * 7/2008 Weber et al. ..... 297/285

FOREIGN PATENT DOCUMENTS

JP 2002136384 A 5/2002
WO 03063651 8/2003
WO 2005117652 12/2005
WO 2006107214 A 10/2006

* cited by examiner

ERGONOMIC SIDE CHAIR

FIELD OF THE INVENTION

The present invention generally relates to a device for supporting a user in a seated position and, more particularly, to a device, which supports the lumbar region and more evenly distributes a user's weight, reduces pressure points, and increases a user's comfort level.

BACKGROUND

The application of scientific information to the design of objects, systems and environments for human use has resulted in a revolution in the seating industry. Typically, the cost of applying the scientific information was economical in only the more expensive types of seating (e.g., executive office chairs). The more affordable side chairs, temporary chairs, and stackable chairs were designed more for affordability and ease of storage than for the comfort of the user.

These design priorities led to the design of uncomfortable chairs. For example, chairs are manufactured with large apertures in the center of the seat to accommodate stacking. U.S. Pat. No. 2,967,565 to Schultz discloses a stackable chair with a large aperture in the center of the seat to allow a number of the chairs to be stacked by sliding the seat's pedestal into the large aperture. The '565 patent also discloses using rigid seats that resist the bending or torsional strains accompanying its ordinary use. The large aperture and the rigid seat make the chair uncomfortable. Other seats failed to provide proper lumbar support. U.S. Pat. No. 5,123,702 to Caruso discloses a stacking chair with an integral seat and backrest in a substantial "L" shape. When a user reclines, the backrest and seat flatten out causing the user to slide forward on the seat. Further, because the backrest pivots at the base connection with the seat, the user's lumbar is not supported. Another patent, U.S. Pat. No. 5,868,468 to Wang, discloses a chair having an adjustable inclination. The '468 patent discloses a backrest that pivots at a point below the seat and, therefore, cannot provide proper lumbar support for the user.

As more is learned about the operation of the human body and through technological advances, the design priorities for more affordable, temporary, and stackable chairs now include user comfort. The present invention solves all of the problems associated with the related art by providing an ergonomic chair in which the comfort of the user is a design priority.

SUMMARY OF THE INVENTION

An embodiment of the chair comprises a support means and a seat attached to the support means. Preferably the seat is a one-piece shell and has tab-forming slots in a pressure-reducing pattern at predetermined pressure point locations. The predetermined pressure point locations may be in the zones of the user's ischial protuberosities (i.e., sitting bones) when the user is properly seated and the pressure-reducing pattern can be an H-pattern, an elongated H-pattern, or any other tab-forming pattern.

In another aspect of the invention, the chair comprises a left side front leg, a right side front leg, a left side rear leg attached to the seat, a right side rear leg attached to the seat, and a front crossbar attached between the front legs. Preferably, the front of the seat is attached to a mesial point of the front crossbar. In a preferred embodiment, the seat has at least one slot in the front of the seat for defining two flexing seat extensions. The two flexing seat extensions preferably are able to move in relation to one another. In an alternative embodiment, the slot in the front of the seat is "V" shaped. A further aspect of the invention may also comprise a left side lumbar mount extending above the seat and attached to the left rear leg, a right side lumbar mount extending above the seat and attached to the right rear leg, a lumbar support means attached to the left side lumbar mount and the right side lumbar mount, and a backrest attached to the lumbar support means. Preferably, the lumbar support means comprises a band of elastic material (e.g., elastomer, textile, or the like), but alternatively it may comprise a pair of connectors (e.g., flap of elastic material or a ball joint). Specifically, the alternative embodiment comprises a left side connector attached to the left side lumbar mount and pivotally attached to the left side of the backrest and a right side connector attached to the right side lumbar mount and pivotally attached to the right side of the backrest. In another aspect, the chair backrest may have one or more vertical slots extending down from the top of the backrest. The vertical slots operate to define two or more flexing backrest extensions, which can move in relation to one another. Instead of a plurality of vertical slots in the backrest, the backrest may have a single vertical slot extending down from the top of the backrest. The single vertical slot would define two flexing backrest extensions, which can move in relation to one another. This embodiment may also include an expanded vertical slot chair grip adapted to accommodate a user's hand.

An alternative embodiment of the chair comprises a support means, a seat attached to the support means, a left side lumbar mount extending above the seat and attached to the support means, a right side lumbar mount extending above the seat and attached to the support means, a lumbar support means attached to the left side lumbar mount and the right side lumbar mount, and a backrest attached to the lumbar support means. The lumbar support means may comprise a left side connector attached to the left side lumbar mount and pivotally attached to the left side of the backrest and a right side connector attached to the right side lumbar mount and pivotally attached to the right side of the backrest. Alternatively, the lumbar support means may be a band of elastic material or the like. The embodiment may also comprise one or more vertical slots extending down from the top of the backrest. Preferably, the one or more vertical slots define two or more flexing backrest extensions, which are able to move in relation to one another. Instead of a plurality of vertical slots in the backrest, the backrest may have a single vertical slot extending down from the top of the backrest. The single vertical slot would define two flexing backrest extensions, which can move in relation to one another. This embodiment may also include an expanded vertical slot chair grip adapted to accommodate a user's hand and can be used as a handle to pick up the chair. In another embodiment of the invention, the support means comprises a left side front leg, a right side front leg, a left side rear leg attached to the seat, a right side rear leg attached to the seat, and a front crossbar attached to the front legs and the seat. Preferably, the seat is attached to a mesial point of the front crossbar and has at least one slot in the front of the seat for defining two flexing seat extensions, which are able to move in relation to one another. In an alternative embodiment the slot in the front of the seat is "V" shaped.

In another aspect of this embodiment of the invention, the seat comprises tab-forming slots in a pressure-reducing pattern at predetermined pressure point locations. It is preferred that the predetermined pressure point locations are in the zones of the user's ischial protuberosities when the user is properly seated. It is also preferred that the pressure-reducing pattern is an H-pattern or an elongated H-pattern.

An alternative embodiment of the invention comprises a support means, a seat attached to the support means, and a backrest having a lumbar region and a flex region. Preferably, the lumbar region is flexible and attached to the support means and the flex region is more flexible than the lumbar region. In one embodiment, the lumbar region and flex region may be constructed of the same material and the lumbar region has a thicker layer of material than the flex region to make it less flexible. In a further embodiment, the lumbar region and flex region are constructed of the same material and the lumbar region is reinforced to make it less flexible. In an even further embodiment, the lumbar region and flex region are constructed of substantially different materials and the lumbar region is a less flexible material than the flex region material.

The present invention may also be constructed with an integral seat and backrest. In this embodiment, the invention comprises a support means and an integral shell having a seat portion and a backrest portion in substantially an L-shape. Preferably, the seat portion is attached to the support means. It is also preferred that the backrest portion has a lumbar region and a flex region where the flex region is more flexible than the lumbar region.

Another aspect of the present invention comprises a spring connected to one or more of the bottoms of the chair legs. In a preferred embodiment, the chair comprises a support means having three or more legs, each of the legs having a top and a bottom, a spring attached the bottom of one or more of the legs, and a seat attached to the support means.

It is an even further aspect of the present invention to have the support means adapted to be telescopically received on additional identical chairs to form a space-saving stack of chairs.

A further alternative embodiment of a stackable chair comprises three or more legs having a top and a bottom, springs attached to the bottom of one or more legs, a seat attached to the top of the legs at two points on either side of the rear of the seat and at the approximate center points of the front of the seat, two lumbar mounts attached to one or more of the legs and extending above the seat, a lumbar support attached between the two lumbar mounts, and a backrest attached to the lumbar support. Preferably, the seat has at least two slots in an elongated H-pattern at predetermined pressure point locations and at least one slot in the front of the seat to allow flexing of the seat An even further alternative embodiment of a stackable chair comprises a left side front leg, a right side front leg, a left side rear leg, a right side rear leg, a front crossbar attached at a proximal end to one front leg and at a distal end to the other front leg, a seat having tab forming slots in an elongated H-pattern in the zones of the user's ischial protuberosities when the user is properly seated, a left side lumbar mount extending above the seat and attached to the left rear leg, a right side lumbar mount extending above the seat and attached to the right rear leg, a band of elastic material attached to the left side lumbar mount and the right side lumbar mount, and a backrest attached to the lumbar support means, a vertical slot extending down from the top of the backrest, defining two flexing backrest extensions, which are able to move in relation to one another. In a preferred embodiment, the front of the seat is attached to a mesial point of the front crossbar and the rear of the seat is attached to the rear legs. It is also preferred that the seat has at least one slot extending from the front of the seat towards the rear of the seat defining two flexing seat extensions, which are able to move in relation to one another.

BRIEF DESCRIPTION OF THE DRAWINGS

For purposes of illustrating the invention, there is shown in the drawings forms, which are presently preferred. It is understood, however, that the invention is not limited to the precise arrangement and instrumentalities shown.

DETAILED DESCRIPTION OF THE INVENTION

Figure 1:
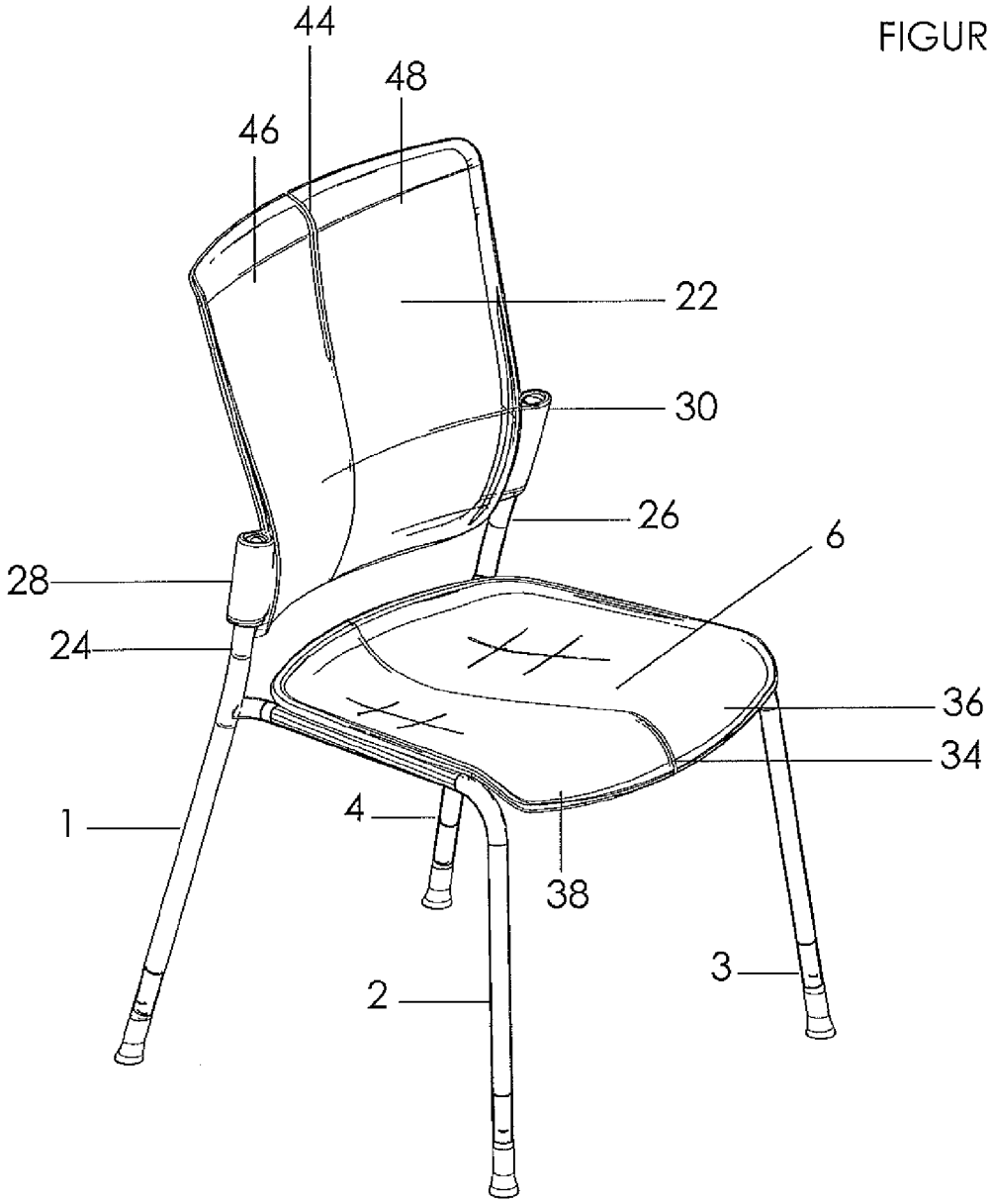
FIG. 1 is an illustration showing a front perspective view of one embodiment of the ergonomic chair.

The present invention will now be described more fully hereinafter with reference to the accompanying drawings, in which preferred embodiments of the invention are shown. This invention may, however, be embodied in many different forms and should no be construed as limited to the embodiments set forth herein. Rather, these embodiments are provided so that this disclosure will be thorough and complete, and will fully convey the scope of the invention to those skilled in the art. Like numbers refer to like elements throughout.

The present invention is a chair, which provides improved comfort while maintaining simplicity in its design. The stackable chair embodiment of the invention is particularly useful when the chairs are for temporary use.

Referring to FIGS. 1 through 8, embodiments of the invention shall be described in detail. Initially, with reference to FIGS. 1-3, a chair having legs 1, 2, 3, 4 and a seat 6 is shown. Right crossbar 14 connects legs 1, 2 and left crossbar 12 connects legs 3, 4. Rear crossbar 10 is connected on one end to the rear portion of right crossbar 14 and on the other end to the rear portion of left crossbar 12, Front crossbar 8 is connected on one end to a front portion of right crossbar 14 and on the other end to front portion of left crossbar 12. Preferably, the legs 1, 2, 3, 4 and crossbars 8, 10, 12, 14 are tubular poles. The cross-section of the legs and crossbars, however, can be a variety of solid or hollow shapes. The legs are substantially vertical and the crossbars are substantially horizontal. It is also preferred that the connection points are welded joints. These connection points may be accomplished by other means such as mechanical fasteners, glues, or the like. Crossbars 8, 10, 12, 14 and legs 1, 2, 3, 4 provide a substantially rectangular frame support means for seat 6. The crossbars 8, 10, 12, 14 are all optional in certain embodiments of the design and may be eliminated by attaching the respective legs to the seat 6. The support means in some embodiments may be three or more legs, a single pedestal, a wall mount, a transverse bar mount, or the like. The only embodiment for which the front crossbar 8 is required is when the seat 6 is attached to a mesial point on the front crossbar 8. In this preferred embodiment, seat 6 is attached to a mesial point of front crossbar 8 by fastener 16. The rear of the seat 6 can be attached directly to rear legs 1, 4 or, preferably, to rear crossbar 10 by fasteners 18, 20. The fasteners 16, 18, 20 can be any type of fasteners including mechanical fasteners, such as screws, grommets, or the like and other fastening means known in the art. Seat 6 is preferably made of flexible plastic and is molded into a dish shape having a downward sloping front portion and an upward sloping rear portion. The flexible plastic seat may be injection molded plastic such as TPR or some other material known in the industry. In a preferred embodiment, leg 3 and left crossbar 12 are a single integral piece shaped substantially into an "L" configuration. Similarly, in a preferred embodiment, the mirror image leg 2 and right crossbar 14 are a single integral piece shaped substantially into an "L" configuration. In an alternative embodiment, the left crossbar 12 and right crossbar 14 are optional and the left front leg 3 and right front leg 4 can be attached directly to the seat or attached to front crossbar 8, which is attached to the seat 6. It is also preferred that rear legs 1, 4 extend above the connection point with crossbars 12, 14 and above the seat 6 to form lumbar mounts 24, 26. Alternatively, the lumbar mounts 24, 26 may be separate members attached to the rear legs 1, 4, the rear crossbar 10, or the seat 6. In an alternative embodiment, armrests, which are well known in the art, may be attached to the lumbar mounts 24, 26 or any other part of the chair.

Figure 3:
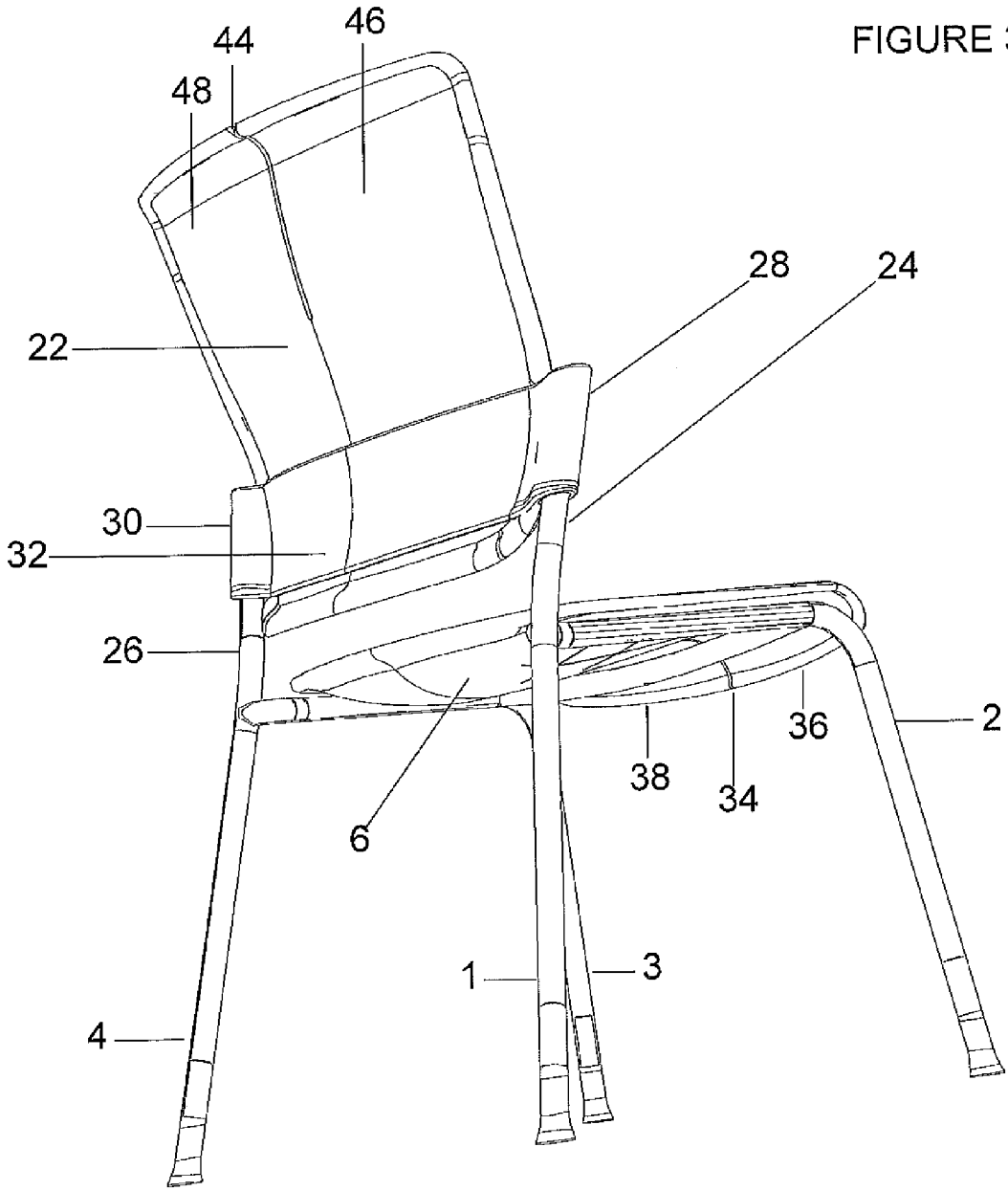
FIG. 3 is an illustration showing the rear perspective view of one embodiment of the ergonomic chair.
Figure 4:
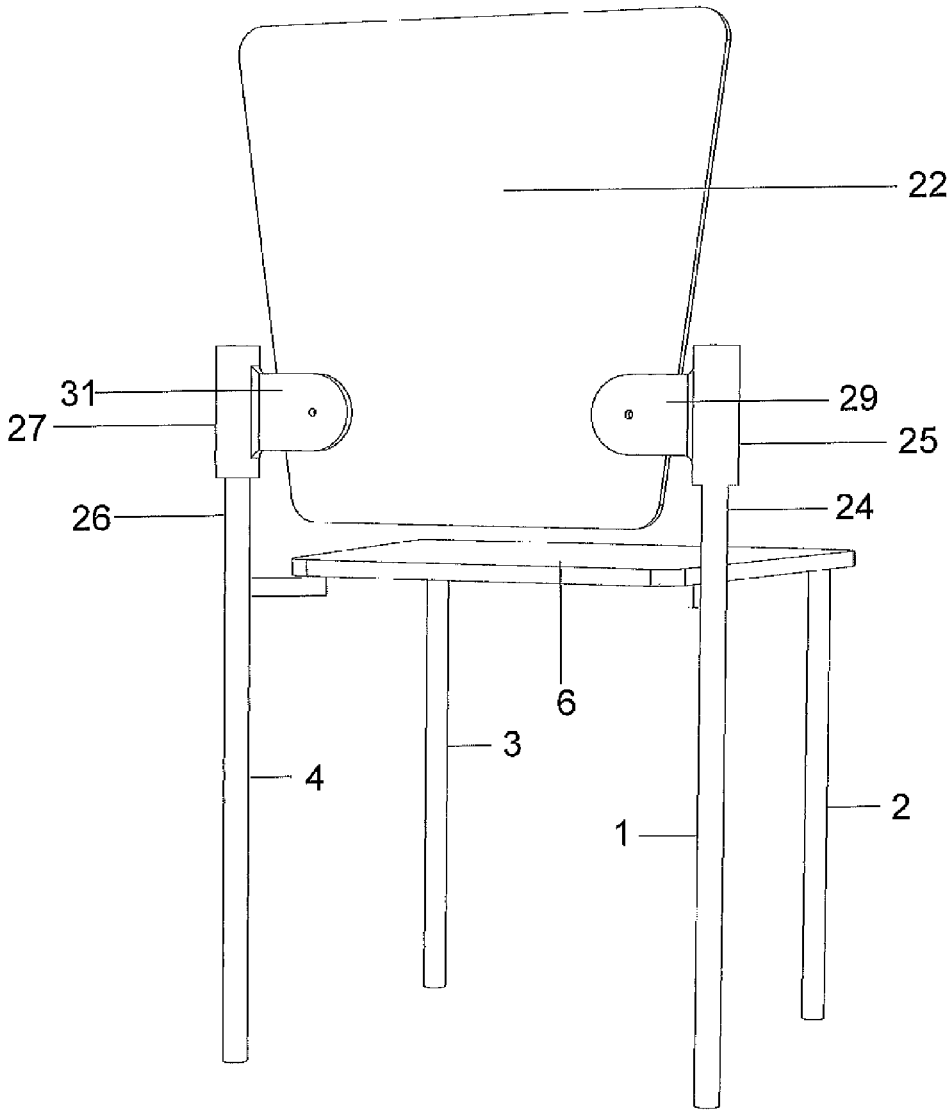
FIG. 4 is an illustration showing a rear perspective view of an alternative embodiment of the ergonomic chair.

The lumbar mounts 24, 26 create the support points for the backrest 22. Referring now to FIG. 3, lumbar support 32 is attached to lumbar mount 24 and lumbar mount 26. The lumbar support 32 may be attached to the lumbar mounts 24, 26 by any means known in the industry. Preferably, lumbar support 32 is attached to lumbar mounts 24, 26 by forming sleeves at the ends 28, 30 of lumbar support 32 and inserting lumbar mounts 24, 26 into sleeves 28, 30. The sleeves 28, 30 surrounding the lumbar mounts 24, 26 can be slid up and down the lumbar mounts 24, 26 to adjust the height of the backrest 22 or they can be fixed in place. Lumbar support 32 is preferably made of an elastic material and exerts a bias on the backrest 22 to place it in an upright or un-reclined position when not occupied. Backrest 22 is attached to lumbar support 32 by mechanical fasteners, glues, or the like. Backrest 22 is preferably made of flexible plastic and is molded into an ergonomic shape, which provides support to the user's lumbar region (i.e., the area between the thoracic vertebrae and sacrum). The flexible plastic seat may be injection molded plastic such as TPR or some other material known in the industry.

In operation, an occupant can recline by applying a rearward pressure on the upper portion of the backrest 22. When the user applies pressure, it acts as a torque force on the lumbar support 32. The lumbar support 32 will twist and allow the backrest to recline. Because the pivot point for the backrest is the lumbar region of the occupant, the bottom of the backrest 22 will move forward as the top of the backrest moves rearward and the chair will continue to support the occupant's lumbar region even in a fully reclined state.

In the alternative embodiments shown in FIGS. 4-7, the backrest is attached to the lumbar mounts 24, 26 using separate pieces of elastic material or other well known mechanical means (e.g., a ball joint) for pivotally connecting the lumbar mounts to the lumbar region of the backrest 22. In this embodiment, lumbar support 32 is not used. The means for connecting the lumbar mounts 24, 26 to the backrest preferably exert a bias on the backrest 22 to place it in the upright or un-reclined position when not occupied. Specifically, with reference to FIG. 4, a connector comprising a sleeve 25, 27, which is attached to lumbar mounts 24, 26, respectively, and an elastic flap 29, 31 attached to the sleeve 25, 27 and the backrest 22 operate as a pivotal connection.

In operation, an occupant can recline by applying a rearward pressure on the upper portion of the backrest 22. When the user applies pressure, it acts as a torque force on the means for connecting the lumbar mounts (i.e., elastic flap 29, 31). The means for connecting the lumbar mounts will twist and allow the backrest to recline. Because the pivot point for the backrest is the lumbar region of the occupant, the top portion of the backrest 22 will move in a rearward direction and the portion of the backrest below the pivot point will move in a forward direction. The pivoting of the backrest 22 will result in the backrest 22 supporting the occupant's lumbar region even in a fully reclined state.

Figure 5:
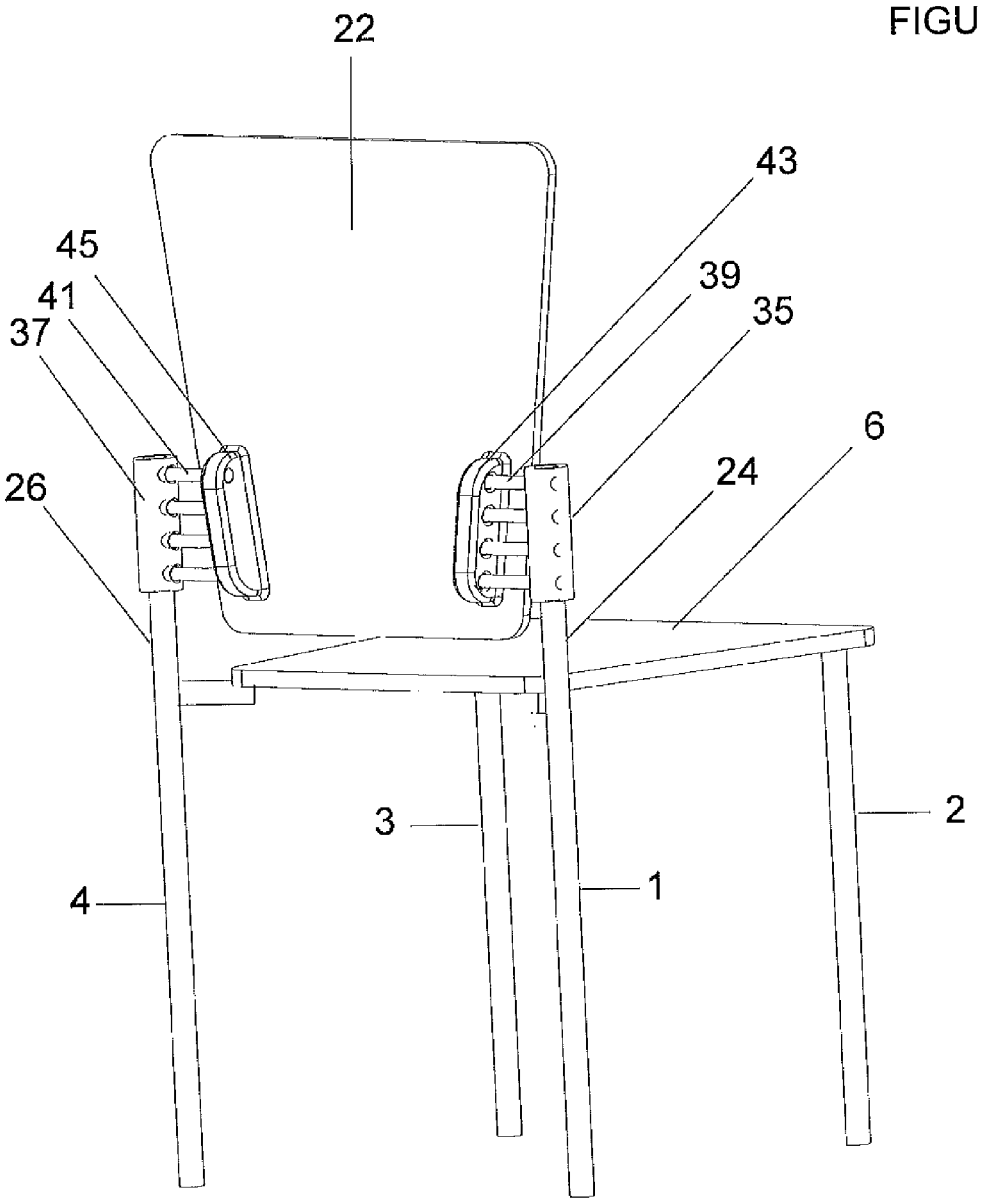
FIG. 5 is an illustration showing a rear perspective view of an alternative embodiment of the ergonomic chair.
Figure 6:
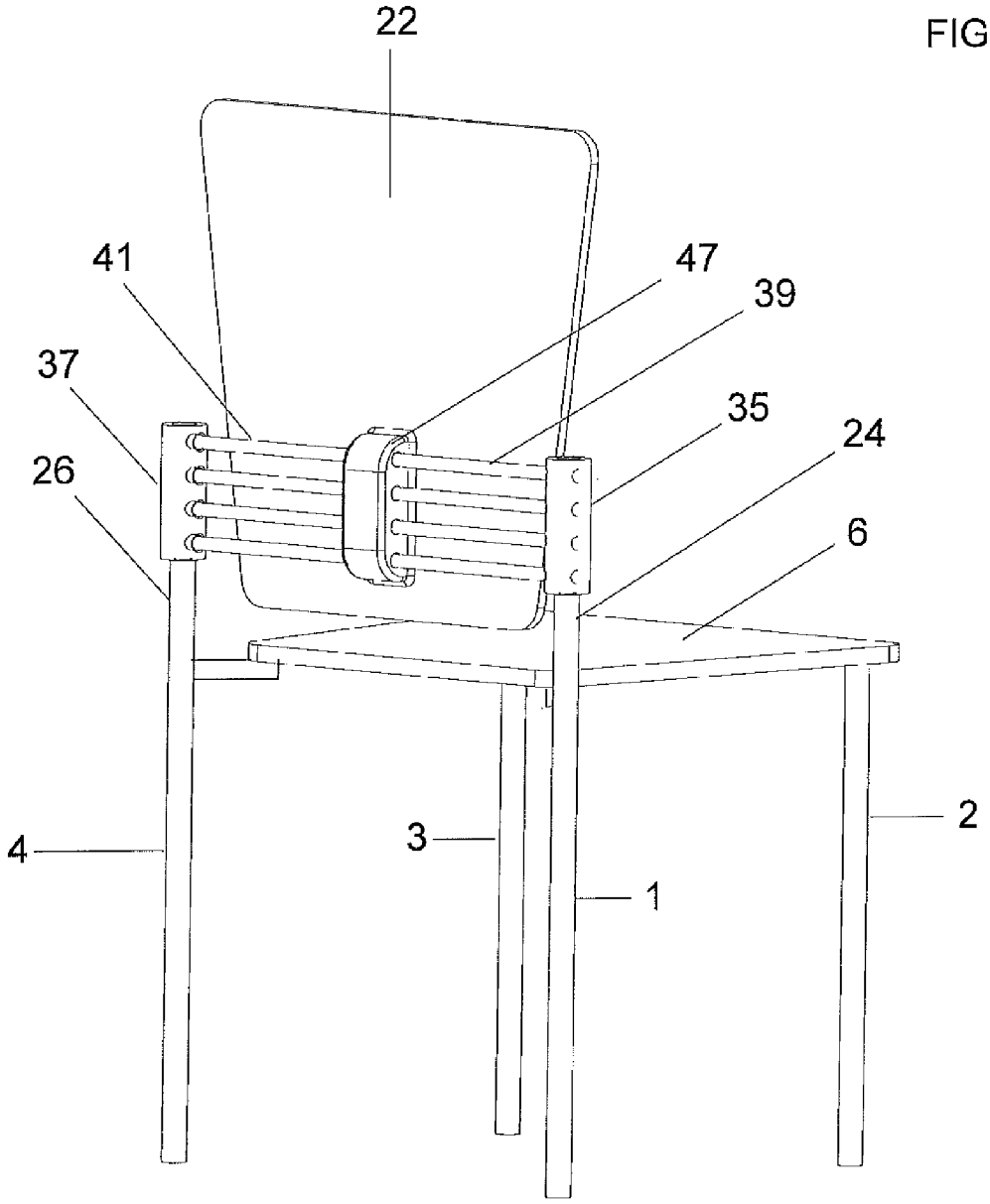
FIG. 6 is an illustration showing a rear perspective view of an alternative embodiment of the ergonomic chair.

Referring to FIG. 5, an alternative embodiment is shown in which the backrest connectors comprise a sleeve 35, 37 attached to lumbar mounts 24, 26, respectively, and backrest mount 43, 45 connected to the backrest 22. A plurality of elastic strips 39, 41 or springs are connected between the sleeve 35, 37 and the backrest mount 43, 45, respectively. The backrest mount 43, 45 is preferably a rectangular member the length of the lumbar region and is adapted to be attached to the backrest 22 and to receive a plurality of elastic strips 39, 41 or springs. The operation is similar to the operation of the embodiment in FIG. 4. Alternatively, this embodiment may have a single backrest mount as shown in FIG. 6. Specifically, the plurality of elastic strips 39, 41 or springs are connected between the sleeve 35, 37 and backrest mount 47.

Figure 7:
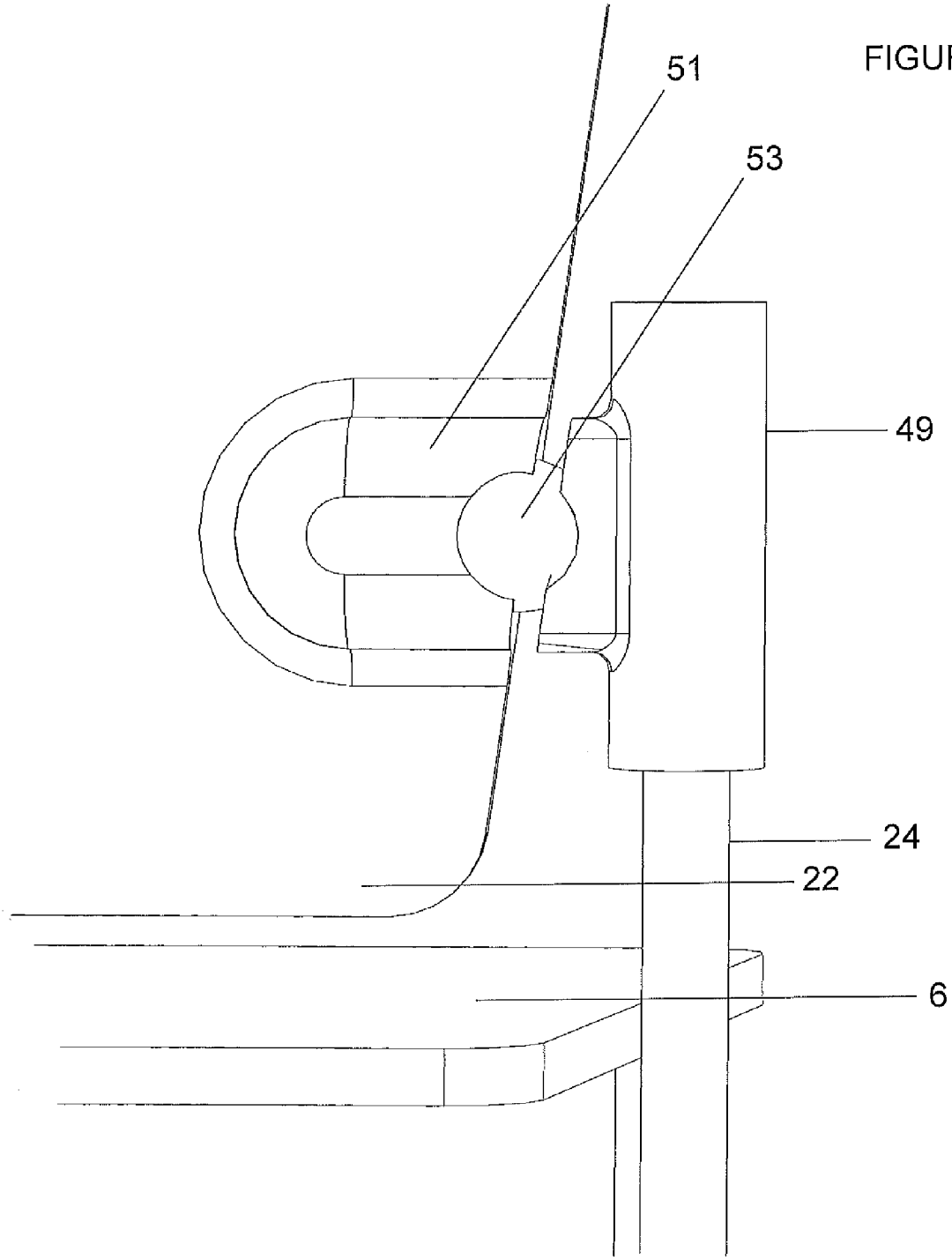
FIG. 7 is an illustration showing a partial rear perspective view of an alternative embodiment of the ergonomic chair.

In another alternative embodiment illustrated in FIG. 7, a ball joint is used to pivotally attach the backrest 22 and lumbar mounts 24, 26. An enlarged drawing of the ball joint is shown in FIG. 7. It should be understood that the side not shown is a mirror image of the side shown. Specifically, a first ball joint mount 49 is attached to lumbar mount 24. Preferably, the first ball joint mount 49 has an integral sleeve that slides over lumbar mount 24. A first ball bearing 53 is rotatably attached to first ball joint mount 49. A first ball joint member 51 is fixedly attached to backrest 22 and rotatably attached to the first ball bearing 53. The ball joint structure is for illustrative purposes only and it should be understood that any mechanical linkage means for pivotally connecting the backrest to the lumbar mounts can be used. In a preferred embodiment, the ball joint includes a spring bias to place the backrest in an upright or un-reclined position when not occupied.

Another alternative embodiment comprises a backrest with a flex region located in the upper portion of the backrest and a lumbar region in the lower portion of the backrest. The flex region is more flexible than the lumbar region. The difference in flexibility of the regions can be accomplished in several ways. Specifically, the difference in flexibility may be achieved by making (1) the flex region and the lumbar region from the same material, but the flex region is made more flexible by it being a thinner layer of material than the lumbar region; (2) the flex region and the lumbar region could be made from the same material, but the lumbar region is made less flexible by reinforcing it with another material (e.g., metal) or additional structure (e.g., spines, struts, or trusses); or (3) the lumbar region is made from a less flexible material than the flex region. However the backrest is made into two regions of differing flexibility, it is then attached to the lumbar mounts either directly or in a manner described in one of the other embodiments.

In operation, an occupant can recline by applying a rearward pressure on the flex region (upper portion) of the backrest 22. The flex region will deflect in a rearward direction and at the same time the lumbar region will deflect in a rearward direction—albeit less than the flex region because of the regions relative flexibilities. Because the pivot point for the backrest is the lumbar region of the occupant, the chair will continue to support the occupant's lumbar region even in a fully reclined state.

The ability to recline the backrest 22 and maintain lumbar support vastly increases the comfort of the chair. The user's comfort is further increased by re-distribution of an occupant's weight over a greater area of the chair to reduce pressure points on the occupant's body. This re-distribution or equalization of pressures is accomplished by designing the seat and backrest to flex at the places where high pressure points typically occur.

The seat 6 and backrest 22 are made more flexible by the inclusion of one or more types of pressure-reducing slots. A slot is a cut, which is completely through the material. A pressure-reducing slot is located on the front of the seat near its center. The front seat slot 34 extends from the front of the seat approximately four inches towards the rear of the seat to form front seat extensions 36, 38. It should be understood that the slot may be longer or shorter than 4 inches and the specific measurement was provided for illustrative purposes only. The front seat extensions 36, 38 are able to deflect downward independently from one another when a user exerts a downward force with his legs. This is possible because the front of the seat 6 is connected at a single mesial point of front crossbar 8 by fastener 16 and the front seat extensions 36, 38 extend beyond the front crossbar 8. Thereby, allowing the unattached front seat extensions 36, 38 to move. In operation, the occupant's legs will be supported by the front seat extensions 36, 38, but will deflect downward or twist when the pressure on the occupant's legs exceeds the amount of pressure needed to flex the front seat extensions 36, 38. The seat, therefore, can be constructed to flex at a point before the pressure on the occupant's leg becomes uncomfortable.

Figure 2:
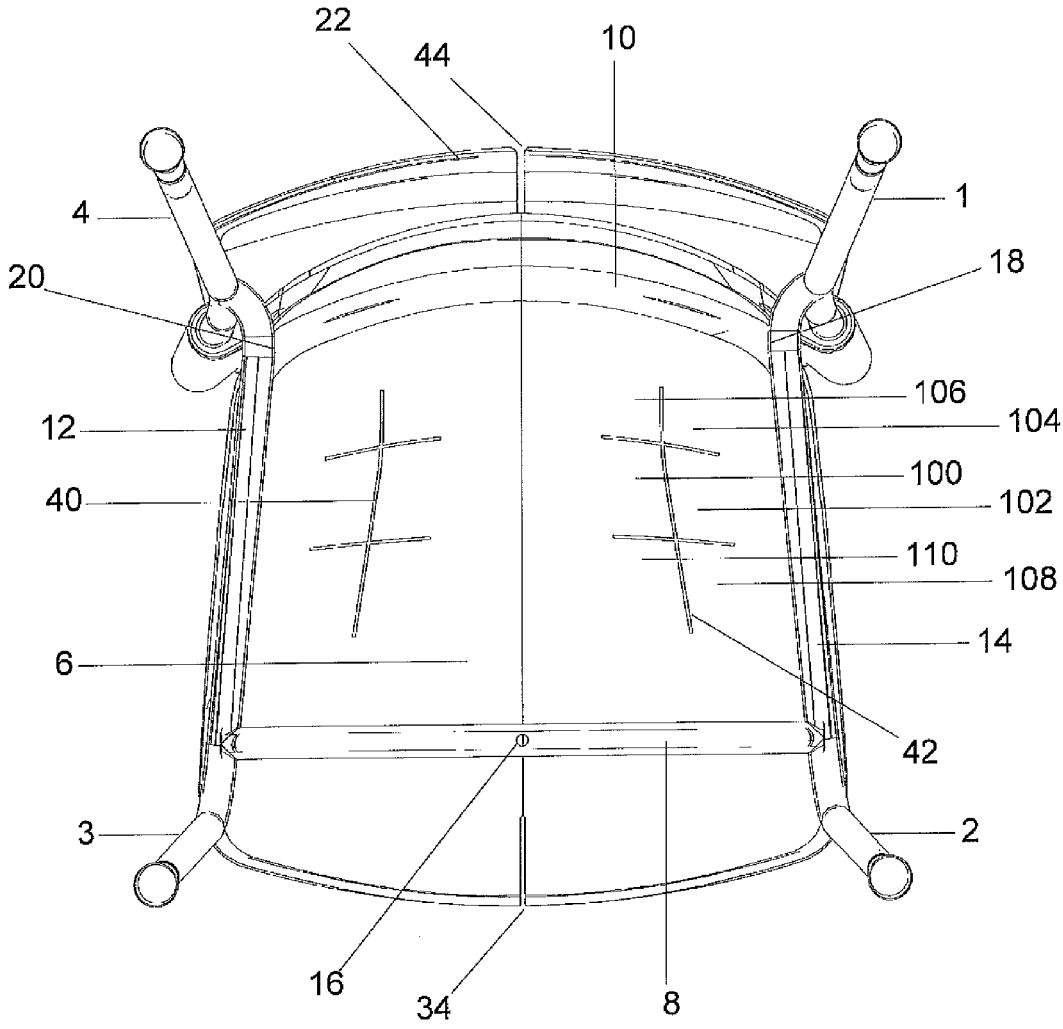
FIG. 2 is an illustration showing the bottom view of one embodiment of the ergonomic chair.

The seat also has pressure-reducing slots in the zones of the user's ischial protuberosities, or commonly referred to as the user's sitting bones. It is these sitting bones that receive the highest amount of pressure when seated. As depicted in FIGS. 1 & 2, the zones of the user's ischial protuberosities, when a user is properly seated, are typically located on the rear of the seat 6. As shown in FIG. 2, the slots for the sitting bones are formed, preferably, in an elongated "H" pattern in the seat 6. The elongated "H" pattern slots 40, 42 are mirror images of one another in FIG. 2. Seat 6 may also have an "H" pattern slot instead of an elongated "H" pattern slot. The elongated "H" pattern slots and the "H" pattern slots form tabs in the seat. The elongated "H" pattern slot 40, 42, preferably, comprises a single line in one direction and two lines substantially perpendicular to and intersecting the single line. The single line can be from substantially front to back of the seat or substantially side-to-side of the seat. One of the differences between the elongated "H" pattern is the single line of the elongated "H" pattern extends beyond the intersection point with the two perpendicular lines and the single line of the "H" pattern terminates at the intersecting point with perpendicular lines. Further, the elongated "H" pattern has slots that form substantially rectangular tabs that are disconnected from the seat on two sides (two-sided tabs 104, 106, 108, 110) or three sides (three-sided tabs 100, 102). The three-sided tabs 100, 102 will flex under less pressure than the two-sided tabs 104, 106, 108, 110. The "H" pattern will have only three-sided tabs 100, 102. It is to be understood that any slot pattern that forms flexible tabs may be used.

The chair may also have a pressure-reducing slot in the backrest. The backrest slot 44 extends from the top of the backrest 22 towards the bottom of the backrest. The backrest slot 44 allows the backrest's upper halves 46, 48 to flex independently of one another. For example, as the user turns right, his right shoulder exerts a rearward force on backrest extension 46 causing it to flex in the rearward direction while backrest extension 48 remains in place and continues to support the left side of the occupant's back. Preferably, the backrest slot 44 is approximately eight inches long. Although, the backrest slot 44 may be longer or shorter than eight inches depending on the desired flexibility. Optionally, the backrest slot 44 forms a chair grip at its midpoint by widening to approximately five inches for approximately two inches and then narrowing again to the width of the slot. The five-inch by two-inch rectangular cutout or chair grip is large enough to accommodate a human hand and acts as a handle for carrying and lifting the chair.

Figure 8:
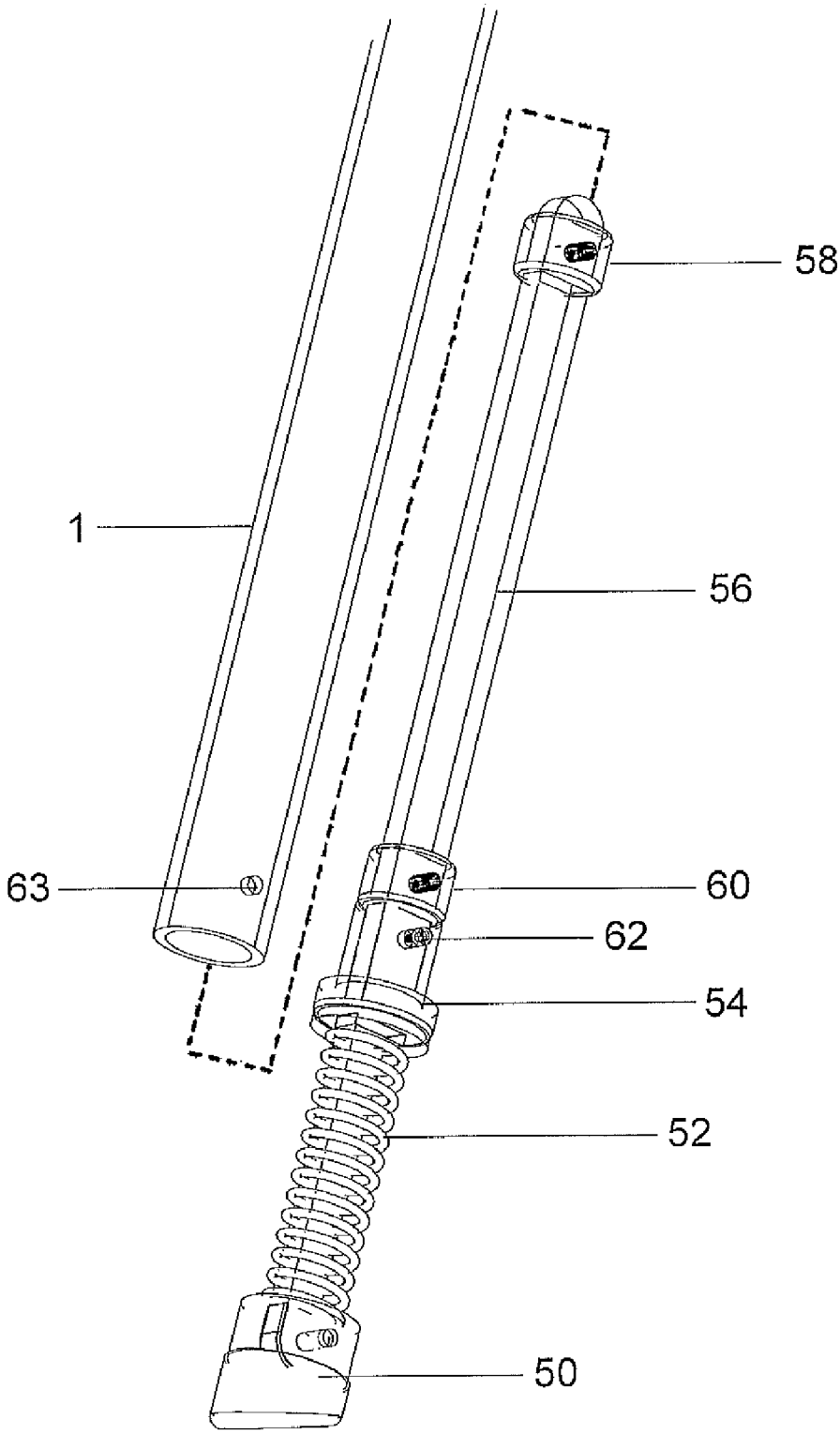
FIG. 8 is an illustration showing a spring mechanism and a leg of the ergonomic chair.

Another aspect of the invention is one that is often ignored when designing non-cushioned chairs. As a user moves from a standing position to a sitting position, the body will develop some momentum to continue downward when the user's body comes in contact with the seat. On cushioned chairs, the momentum force is dissipated by slowly decelerating the user by compressing the cushion, A non-cushioned chair, however, cannot slowly decelerate the user and as a result, the user will impact the seat. This impact may cause the user discomfort or in extreme cases may cause injury to the user. The embodiment illustrated in FIG. 8 uses a spring mechanism to reduce the impact on the user. Essentially, the spring mechanism acts to slowly decelerate the user by compressing a spring just as a cushioned seat decelerates a user by compressing the cushion. One or more of the legs may have spring mechanisms interposed between the legs and the floor. Specifically, the spring mechanism comprises a foot 50 attached to a rod 56. The rod 56 is partially contained in a cavity of the chair's leg and partially outside the leg cavity. FIG. 8 shows the spring mechanism removed from the leg cavity for the purposes of showing the structure of the spring mechanism. In operation, the entire spring mechanism above cap 54 is contained in the leg cavity. The cap 54 fits adjacent to the bottom of the leg. The cap 54 has an opening through which the rod 56 may slide. A spring surrounds the rod 56 between the foot 50 and the cap 54. Preferably, spacers 58, 60 assist the rod in sliding smoothly within the leg cavity. Screw 62 secures the spring mechanism to the leg through screw-hole 63, Preferably, the spring mechanism is attached to the rear legs 1, 4.

In operation, when the seat is unoccupied, spring 52 is fully extended and the minimum amount of rod 56 is contained in the leg cavity. The chair will be elevated in this unoccupied state. When the seat is occupied, the weight of the occupant will cause the spring 52 to compress and will drive the rod 56 further up into the leg cavity. The seat will move in a downward direction until the downward force exerted by the occupant's weight equals the upward force exerted by the spring.

The operation of the preferred embodiment of the ergonomic chair will now be described. A user sitting down would initially feel the seat move downward as the rear leg springs 50, 52 compressed. This downward movement relieves a portion of the initial impact pressure on the occupant from the act of sitting down. As the occupant settles into the seat, the three-sided tabs 100, 102 would flex in a downward direction and two-sided tabs 104, 106, 108, 110 would flex in a downward direction to a lesser degree than three-sided tabs 100, 102. The flexing of these tabs causes the occupant's weight to be supported to a greater degree by sections of the seat outside of the occupant's ischial protuberosities zones. This redistribution results in an equalization of forces on the occupant, which increases the occupant's comfort. A further equalization of pressures on the occupant results from the front seat slot, which allows the front seat extensions 36, 38 of the seat 6 to move in a downward direction. As the front seat extensions 36, 38 flex downwardly, other sections of the seat begin to support the occupant to a greater extent until the forces on the occupant are sufficiently redistributed so that the front seat extensions 36, 38 do not deflect any further.

As would be readily envisioned by one of skill in the art, the various mechanisms described herein are particularly useful in combination for providing functional, attractive support mechanisms that allow for easy position adjustment of attached devices. All combinations of the multiple mechanisms described herein are therefore encompassed by the present invention.

Preferentially, unless otherwise indicated the various components of the present invention are constructed generally out of a strong, lightweight material, such as aluminum. Various different materials could also be used, such as other metals or plastics.

Many modifications and other embodiments of the inventions set forth herein will come to mind to one skilled in the art to which these inventions pertain having the benefit of the teaching presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

We claim:

1. A chair comprising:

a. a support means;

b. a seat attached to the support means, the seat having a front and a rear;

c. a left side lumbar mount attached to the support means, the left side lumbar mount extending above the seat;

d. a right side lumbar mount attached to the support means, the right side lumbar mount extending above the seat;

e. an elastic band having a first end attached to the left side lumbar mount and a second end attached to the right side lumbar mount; and f. a backrest having a front, a back, a left side, a right side, a top, a bottom, an upper region, and a lower region; wherein the back of the backrest is attached to the elastic band; and wherein the backrest is capable of reclining by pivoting about the elastic band when a force is applied to the upper region of the backrest.

2. The chair of claim 1 wherein the seat further comprises tab-forming slots in a pressure-reducing pattern at predetermined pressure point locations, wherein the predetermined pressure point locations are located in the rear of the seat.

3. The chair of claim 2 wherein the pressure-reducing pattern is an H-pattern.

4. The chair of claim 2 wherein the pressure-reducing pattern is an elongated H-pattern.

5. The chair of claim 4 wherein the support means comprises:

a. a left side front leg having a top and a bottom;

b. a right side front leg having a top and a bottom;

c. a left side rear leg having a top and a bottom, the top being attached to the seat;

d. a right side rear leg having a top and a bottom, the top being attached to the seat; and e. a front crossbar attached at a proximal end to the top of the left side front leg and at a distal end to the top of the right side front leg, the front crossbar being attached to the seat.

6. The chair of claim 5 wherein the seat is attached to a mesial point of the front crossbar, the seat having at least one slot in the front of the seat for defining two flexing seat extensions, the two flexing seat extensions extending beyond the front crossbar, the two flexing seat extensions being able to move in relation to one another.

7. The chair of claim 6 wherein the slot in the front of the seat for defining two flexing seat extensions is "V" shaped.

8. The chair of claim 6 wherein the left side lumbar mount is attached to the left rear leg and the right side lumbar mount is attached to the right rear leg.

9. The chair of claim 8 further comprising one or more vertical slots in the backrest, the one or more vertical slots extending down from the top of the backrest, the one or more vertical slots defining two or more flexing backrest extensions, the two or more flexing backrest extensions being able to move in relation to one another.

10. The chair of claim 8 further comprising a vertical slot in the backrest, the vertical slot extending down from the top of the backrest, the vertical slot defining two flexing backrest extensions, the two flexing backrest extensions being able to move in relation to one another.

11. The chair of claim 10 wherein the support means is adapted to be telescopically received on additional identical chairs to form a space-saving stack of chairs.

12. The chair of claim 10 wherein the seat is a one-piece shell.

13. The chair of claim 8 wherein one or more springs are connected to one or more of the bottoms of the legs.

14. The chair of claim 1 wherein the elastic band comprises rubber.

15. The chair of claim 1 wherein the elastic band comprises leather.

16. The chair of claim 1 wherein the elastic band comprises an elastomer.

17. The chair of claim 1, wherein the lower region is adapted to be flexible, and the upper region is adapted to be more flexible than the lower region.

18. The chair of claim 17 wherein the lower region and upper region are constructed of substantially different material and the lower region is a less flexible material than the upper region material.

19. A chair comprising:

a. a support means;

b. a seat attached to the support means, the seat having a front and a rear;

c. a left side lumbar mount formed by an extension of the support means, the left side lumbar mount extending above the seat;

d. a right side lumbar mount formed by an extension of the support means, the right side lumbar mount extending above the seat;

e. an elastic band having a first end attached to the left side lumbar mount and a second end attached to the right side lumbar mount; and f. a backrest having a front, a back, a left side, a right side, a top, a bottom, an upper region, and a lower region; wherein the back of the backrest is attached to the elastic band; and wherein the backrest is capable of reclining by pivoting about the elastic band when a force is applied to the upper region of the backrest.

20. The chair of claim 19 wherein the elastic band comprises rubber.

21. The chair of claim 19 wherein the elastic band comprises leather.

22. The chair of claim 19 wherein the elastic band comprises an elastomer.

23. The chair of claim 19 further comprising one or more vertical slots in the backrest, the one or more vertical slots extending down from the top of the backrest, the one or more vertical slots defining two or more flexing backrest extensions, the two or more flexing backrest extensions being able to move in relation to one another.

24. The chair of claim 19 further comprising a single vertical slot in the backrest, the vertical slot extending down from the top of the backrest, the vertical slot defining two flexing backrest extensions, the two flexing backrest extensions being able to move in relation to one another.

25. The chair of claim 24 wherein the support means comprises:

a. a left side front leg having a top and a bottom;

b. a right side front leg having a top and a bottom;

c. a left side rear leg having a top and a bottom, the top being attached to the seat;

d. a right side rear leg having a top and a bottom, the top being attached to the seat; and e. a front crossbar attached at a proximal end to the top of one front leg and at a distal end to the top of the other front leg, the front crossbar being attached to the seat.

26. The chair of claim 25 wherein the seat is attached to a mesial point of the front crossbar, the seat having at least one slot in the front of the seat for defining two flexing seat extensions, the two flexing seat extensions extending beyond the front crossbar, the two flexing seat extensions being able to move in relation to one another.

27. The chair of claim 26 wherein the slot in the front of the seat for defining two flexing seat extensions is "V" shaped.

28. The chair of claim 26 wherein one or more springs are connected to one or more of the bottoms of the legs.

29. The chair of claim 26 wherein the support means is adapted to be telescopically received on additional identical chairs to form a space-saving stack of chairs.

30. The chair of claim 26 wherein the seat is a one-piece shell.

31. The chair of claim 26 wherein the seat further comprises tab-forming slots in a pressure-reducing pattern at predetermined pressure point locations.

32. The chair of claim 31 wherein the predetermined pressure point locations are located in the rear of the seat.

33. The chair of claim 32 wherein the pressure-reducing pattern is an H-pattern.

34. The chair of claim 32 wherein the pressure-reducing pattern is an elongated H-pattern.

35. A chair comprising:

a. a support means;

b. a seat attached to the support means;

c. a left side lumbar mount connected to the support means, the left side lumbar mount extending above the seat;

d. a right side lumbar mount connected to the support means, the right side lumbar mount extending above the seat;

e. an elastic band having a first end attached to the left side lumbar mount and a second end attached to the right side lumbar mount; and f. a backrest attached to the elastic band, the backrest having an upper region and a lower region, wherein the elastic band extends across the backrest's lower region such that the backrest is capable of reclining by pivoting about the elastic band when a force is applied to the upper region of the backrest.

36. The chair of claim 35, wherein the left side lumbar mount and the right side lumbar mount are each integrally connected to the support means.

37. A stackable ergonomic chair comprising:

a. a left side front leg having a top and a bottom;

b. a right side front leg having a top and a bottom;

c. a left side rear leg having a top and a bottom;

d. a right side rear leg having a top and a bottom;

e. a front crossbar attached at a proximal end to the top of the left side front leg and at a distal end to the top of the right side front leg;

f. a seat having tab forming slots in an elongated H-pattern located in the rear of the seat, the seat having a front and a rear, the seat being a one-piece shell, the front of the seat being attached to a mesial point of the front crossbar, the seat having at least one slot in the front of the seat for defining two flexing extensions, the two flexing seat extensions extending beyond the front crossbar, the two flexing seat extensions being able to move in relation to one another;

g. a left side lumbar mount attached to the left rear leg, the left side lumbar mount extending above the seat;

h. a right side lumbar mount attached to the right rear leg, the right side lumbar mount extending above the seat;

i. a band of elastic material attached to the left side lumbar mount and the right side lumbar mount; and j. a backrest defining a front and a back, wherein the back of the backrest is attached to the band of elastic material;

k. a vertical slot in the backrest, the vertical slot extending down from the top of the backrest, the vertical slot defining two flexing backrest extensions, the two flexing backrest extensions being able to move in relation to one another.

38. A chair comprising:

a. a frame;

b. a seat attached to the frame;

c. a left side lumbar mount extending above the seat;

d. a right side lumbar mount extending above the seat;

e. an elastic band having a first end attached to the left side lumbar mount and a second end attached to the right side lumbar mount; and f. a backrest having an upper region and a lower region, the backrest's lower region attached to the elastic band; wherein the elastic band twists when a rearward force is applied to the backrest's upper region to allow the backrest to recline.

* * * * *